US006050797A

United States Patent [19]

Zhong

[11] Patent Number: 6,050,797

[45] Date of Patent: Apr. 18, 2000

[54] SCREW COMPRESSOR WITH BALANCED THRUST

[75] Inventor: Jianping Zhong, Manlius, N.Y.

[73] Assignee: Carrier Corporation, Syracuse, N.Y.

[21] Appl. No.: 09/080,566

[22] Filed: May 18, 1998

[51] Int. Cl.[7] ..... F01C 1/16

[52] U.S. Cl. ..... 418/203

[58] Field of Search ..... 418/194, 203

[56] References Cited

U.S. PATENT DOCUMENTS 3,947,163 3/1976 Olofsson ..... 418/203

5,135,374 8/1992 Yoshimura et al. ..... 418/203 X 5,281,115 1/1994 Timuska ..... 418/203 X 5,350,286 9/1994 Kisi et al. .

5,678,987 10/1997 Timuska .

5,707,223 1/1998 England et al. .

*Primary Examiner*—Hoang Nguyen

[57] ABSTRACT

The shaft portion of a screw rotor is axially loaded to offset the thrust loading of the screw rotor due to forces exerted on the screw rotor by fluid being compressed and tending to move the screw rotor from the discharge towards suction. This permits the elimination of the thrust bearings. Preferably, the discharge end of the lobes of the rotors is beveled canted so as to generate a hydrodynamic film during operation.

9 Claims, 5 Drawing Sheets

SCREW COMPRESSOR WITH BALANCED THRUST

BACKGROUND OF THE INVENTION

In twin rotor screw compressors, the pressure gradient is normally in one direction during operation such that fluid pressure tends to force the rotors towards the suction side. The rotors are conventionally mounted in bearings at each end so as to provide both radial and axial restraint. The end clearance of the rotors at the discharge side is critical to sealing and the fluid pressure tends to force open the clearance. Also, the axial forces tend to drive the suction end of the rotors into the casing which can damage the rotors if contact between the rotor(s) and casing is allowed to occur. The need for bearings, specifically thrust bearings, adds significantly to the cost, complicates manufacturing/assembly, and add maintenance requirements.

SUMMARY OF THE INVENTION

The present invention provides a thrust support system to generate counter forces to balance the thrust forces on screw rotors at both the suction and discharge sides. The thrust support system includes a balance disk (or piston) with a one step or multi-step labyrinth seal machined on its outside diameter. The piston is mounted on the rotor inlet shaft end and fixed by a self-locking nut. The compressor inlet housing is designed and machined to provide a one step or multi-step cylinder for the piston. The cylinder is covered by a plate bolted and sealed by an O-ring or the like to form an enclosed chamber with only a flow leakage path through the labyrinth seals. The cover plate has a tapped hole or flanged connection to a pipe which is connected via threads or a flange to the casing discharge side. A hole is drilled through the casing discharge wall to connect the pipe to the rotor discharge area so that high pressure gas flows to the piston high pressure side. One or more holes are drilled in the compressor inlet housing to connect the rotor inlet area to the piston low pressure side. In such a way, a complete flow recirculation path is formed and the flow rate is controlled by designing to accommodate labyrinth seal leakage and pressure drop.

Alternatively, the flow path can be made through a series of internal drillings in the housing which intersect and which have suitable plugs to prevent leakage.

The thrust on the rotor discharge side is balanced by the force from the piston high pressure side by correctly sizing the piston high pressure area. The thrust on the rotor inlet side is balanced by the force from the piston low pressure side by correctly sizing the piston low pressure area. The resultant thrust of the compressor rotor can be totally balanced or controlled for any given inlet and discharge pressure level.

The thrust support system can also be used to reverse rotor thrust towards the rotor discharge side with a desired force amount. This force axially displaces the rotor against the casing discharge end wall. For an oil flooded application, the rotor discharge end surfaces would be provided with taper land geometry built into the end of each rotor. The taper land thrust areas will generate a hydrodynamic oil film to separate adjacent surfaces during the rotor rotation. For an oil free application, an abradable coating is applied to the rotor discharge end surface for the purpose of creating two conforming surfaces. In both cases, the machine will have a very low running clearance between the rotor discharge surface and the casing end wall. This tight clearance will reduce leakage and improve efficiency.

The thrust support system can be used in either the male rotor, the female rotor, or both rotors, for a given screw compressor.

It is an object of this invention to balance thrust loads in a screw compressor

It is another object of this invention to eliminate the need for thrust bearings in a screw compressor.

It is a further object to reduce the mechanical losses associated with thrust bearings and thereby improve compressor efficiency.

It is another object of this invention to provide a more compact screw compressor design.

It is an additional object of this invention to permit the positioning of screw rotors against the discharge end wall to provide a zero running clearance between the rotor end surface and the casing end wall surface. These objects, and others as will become apparent hereinafter, are accomplished by the present invention.

Basically, the shaft portion of a screw rotor is axially loaded to offset the thrust loading of the screw rotor due to forces exerted on the screw rotor by fluid being compressed and tending to move the screw rotor from the discharge towards suction.

BRIEF DESCRIPTION OF THE DRAWING

For a fuller understanding of the present invention, reference should now be made to the following detailed description thereof taken in conjunction with the accompanying drawings wherein.

DESCRIPTION OF THE PREFERRED EMBODIMENTS

Figure 1A:
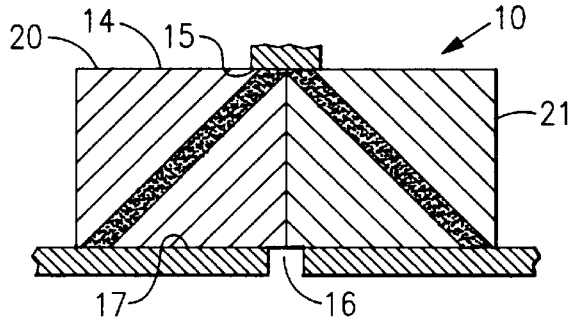
FIGS. 1A–F show unwrapped screw rotors and sequentially illustrate the movement of a trapped volume between intake cutoff and discharge.
Figure 1D:
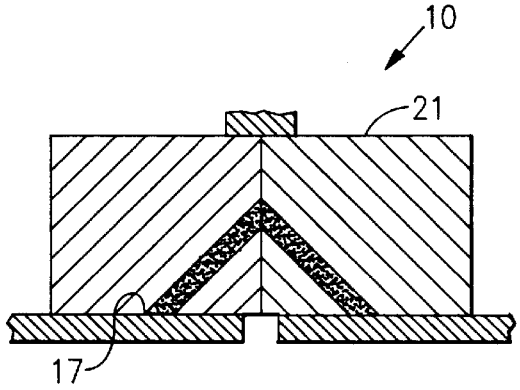
Figure 1B:
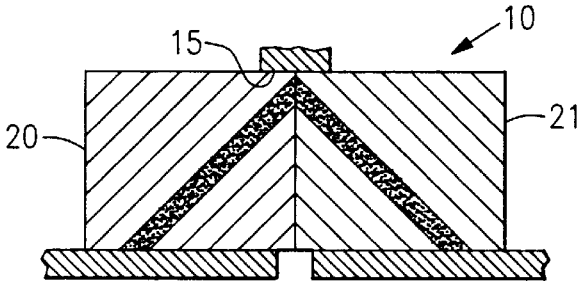
Figure 1E:
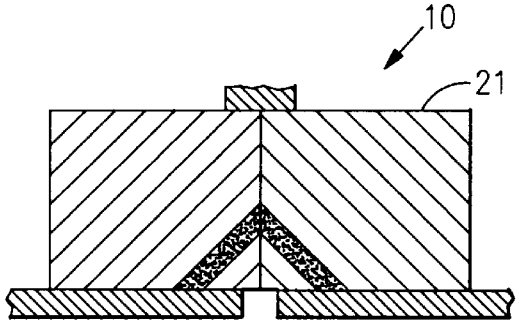
Figure 1C:
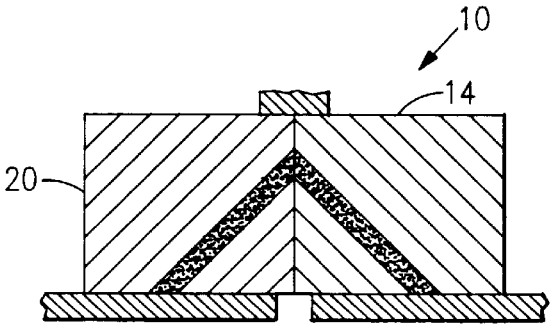
Figure 1F:
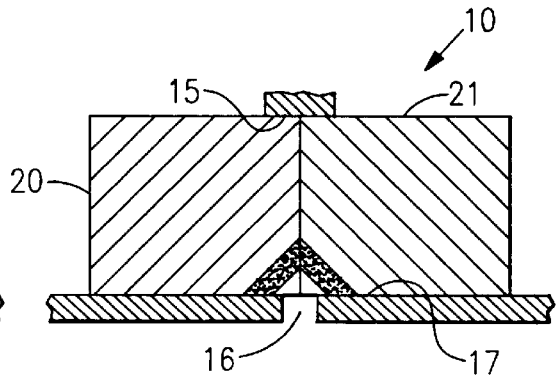

In FIGS. 1A–F, the numeral 20 represents the unwrapped male rotor and the numeral 21 represents the unwrapped female rotor of screw machine 10. Axial suction port 14 is located in end wall 15 and axial discharge port 16 is located in end wall 17. The stippling in FIGS. 1A–F represents the trapped volume of refrigerant starting with the cutoff of suction port 14 in FIG. 1A and progressing to a point just prior to communication with axial discharge port 16 in FIG. 1F. With the exception of FIG. 1A where the trapped volume is essentially at suction pressure, the trapped volume exerts an axial or thrust loading only on end wall 17. As the trapped volume advances from the FIG. 1A position to the FIG. 1F position, the trapped volume decreases with a corresponding increase in the axial or thrust loading on end wall 17. The thrust loading tends to separate rotors 20 and 21 from end wall 17 and, as is clear from FIGS. 1A–F, separation would provide a leak passage between all of the trapped volumes and discharge port 16. As noted above, this thrust loading is normally accommodated with thrust bearings. Commonly assigned U.S. Pat. No. 5,722,163 addresses some of the difficulties associated with limiting leakage when using thrust bearings.

Figure 2:
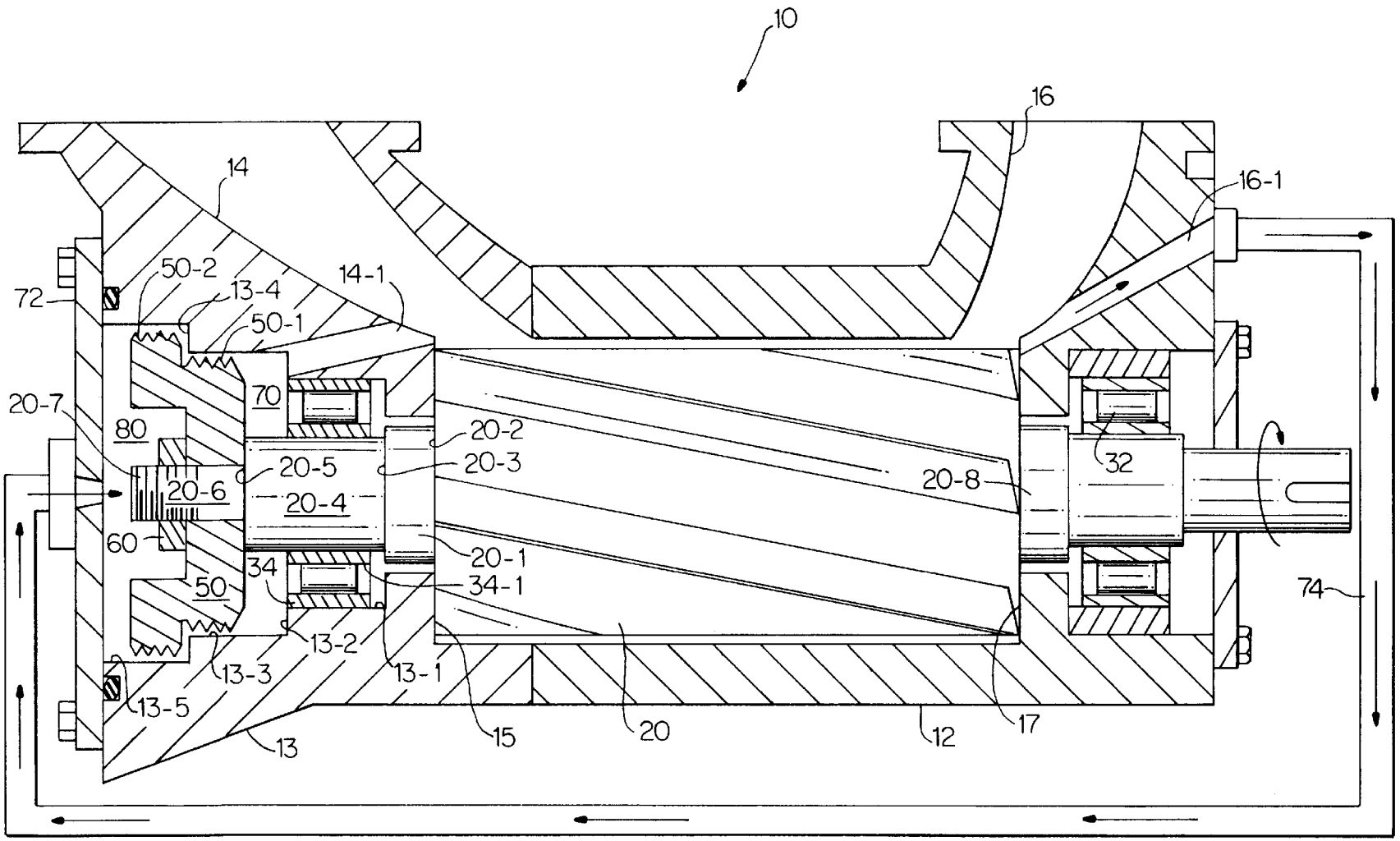
FIG. 2 is a partially sectioned view of a screw machine employing the present invention.

In FIG. 2, the structure has been labeled the same as corresponding structure in FIG. 1. However, to permit a single view depiction of the fluid paths, it was necessary to only illustrated male rotor 20 and to distort some of the structure to complete the fluid connections.

In FIGS. 1–5 the numeral 10 generally designates a screw machine, specifically a twin rotor screw compressor having a male rotor 20 and a female rotor 21. However, the present invention is applicable to screw machines having more than two rotors. Rotor 20 has a shaft portion 20-1, an intermediate reduced diameter portion 20-4 and outer reduced diameter portion 20-6. A first shoulder 20-2 is formed between shaft portion 20-1 and the rotor 20. A second shoulder 20-3 is formed between shaft portions 20-1 and 20-4 and a third shoulder 20-5 is formed between shaft portions 20-4 and 20-6. Shaft portion 20-4 is supported by the inner race 34-1 of roller bearing 34.

Similarly, rotor 21 has a shaft portion 21-1, an intermediate reduced diameter portion 21-4 and outer reduced diameter portion 21-6. A first shoulder 21-2 is formed between shaft portion 21-1 and the rotor 21. A second shoulder 21-3 is formed between shaft portions 21-1 and 21-4 and a third shoulder 21-5 is formed between shaft portions 21-4 and 21-6. Shaft portion 21-4 is supported by the inner race 35-1 of roller bearing 35.

Figure 3:
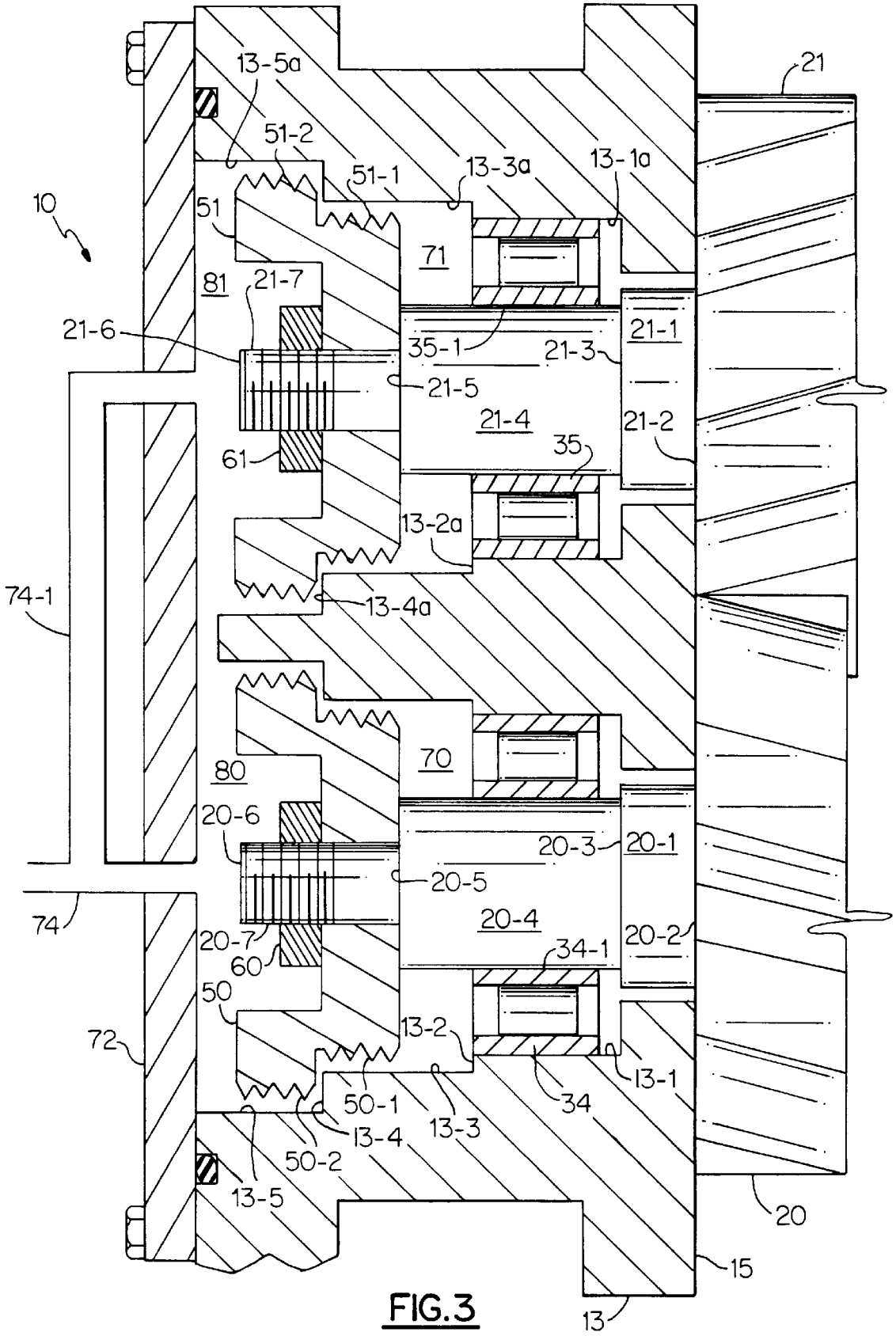
FIG. 3 is an enlarged view of a portion of the suction end of the screw machine of FIG. 2.
Figure 4:
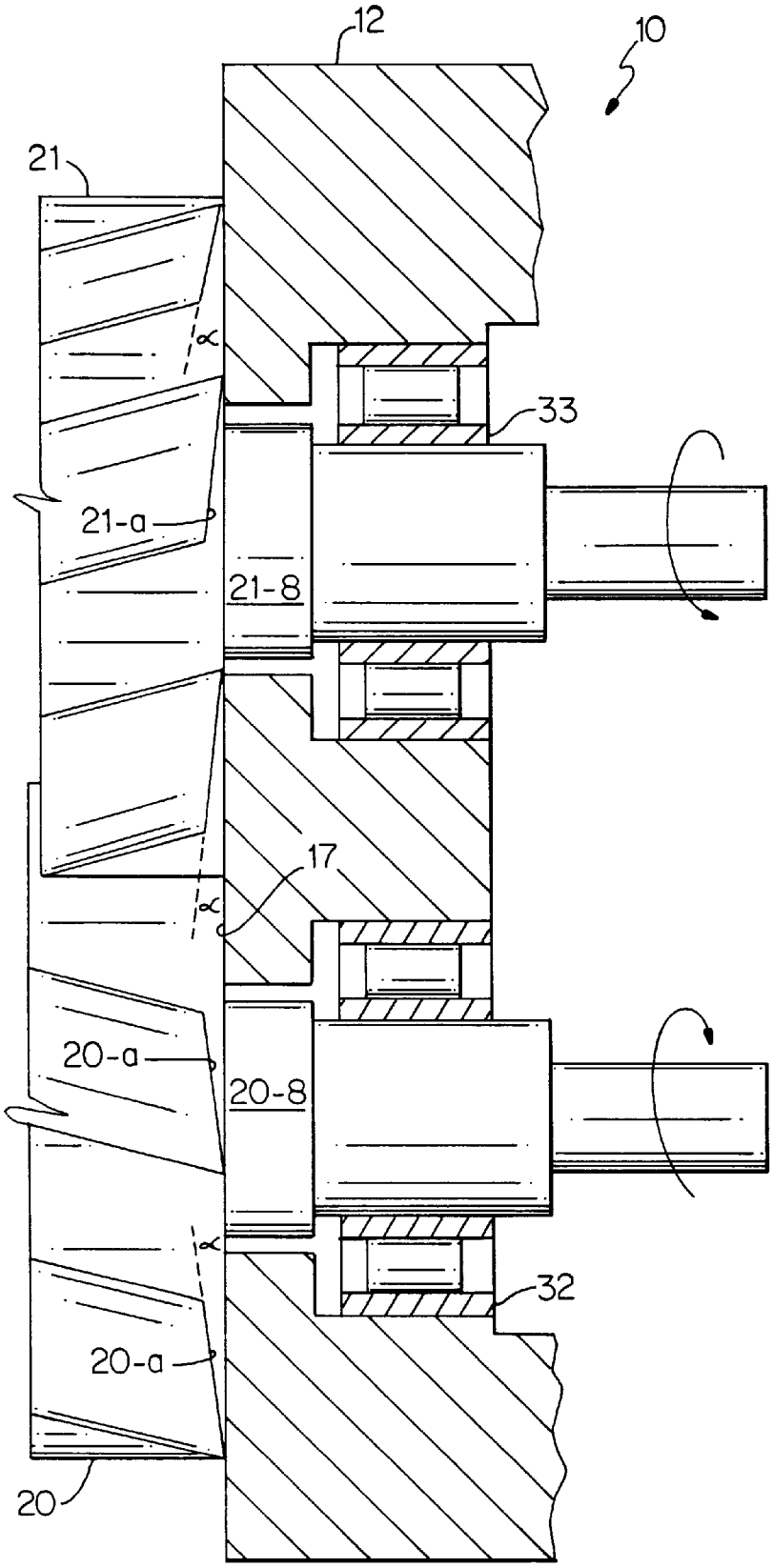
FIG. 4 is an enlarged view of a portion of the discharge end of the screw machine of FIG. 2.

As best shown in FIG. 4, rotors 20 and 21 and their discharge side shaft portions 20-8 and 21-8 are supportingly received in rotor housing 12 with shaft portions 20-8 and 21-8 being supported by roller bearings 32 and 33, respectively. As best shown in FIG. 3, shaft portions 20-1 and 21-1 are supportingly received in inlet casing 13 and supported by roller bearings 34 and 35, respectively. One of rotors 20 and 21 is the driving rotor and is connected to a motor or the like.

In operation, as a refrigerant compressor, assuming male rotor 20 to be the driving rotor, rotor 20 rotates engaging rotor 21 and causing its rotation. The coaction of rotating rotors 20 and 21 draws refrigerant gas via suction inlet 14 into the grooves of rotors 20 and 21 which engage to trap and compress volumes of gas and deliver the hot compressed gas to discharge port 16.

The structure and operation described so far is generally conventional. Referring primarily to FIGS. 2 and 3, inlet casing 13 has first bores 13-1 and 13-1*a* which receive roller bearings 34 and 35, respectively, intermediate bores 13-3 and 13-3*a* which are separated from first bores 13-1 and 13-1*a* by shoulders 13-2 and 13-2*a*, respectively, and outer bores 13-5 and 13-5*a* which are separated from intermediate bores 13-3 and 13-3*a* by shoulders 13-4 and 13-4*a*, respectively. The present invention adds balance disks or pistons 50 and/or 51 which are located on shaft portions 20-6 and 21-6, respectively, and held in sealing engagement with shoulders 20-5 and 21-5 by lock nuts 60 and 61, respectively, which are threaded onto threaded portions 20-7 and 21-7 of shaft portions 20-6 and 21-6, respectively. Balance disk or piston 50 has a first diameter portion 50-1 defining a labyrinth which is received in bore 13-3 and a second, larger diameter portion 50-2 defining a second labyrinth seal which is received in bore 13-5. Balance disk or piston 50 coacts with bore 13-3 and shaft portion 20-4 to define an annular chamber 70 which is in fluid communication with suction inlet 14 via low pressure passage 14-1.

Similarly, balance disk or piston 51 has a first diameter portion 51-1 defining a labyrinth seal which is received in bore 13-3*a* and a second, larger diameter portion 51-2 defining a second labyrinth seal which is received in bore 13-5*a*. Balance disk or piston 51 coacts with bore 13-3*a* and shaft portion 21-4 to define an annular chamber 71 which, like chamber 70, is in fluid communication, either directly or via branch passages (not illustrated), with suction inlet 14 via low pressure passage 14-1.

Cover plate 72 is sealingly secured to inlet casing 13 and coacts with bores 13-5 and 13-5*a* and balance disks or pistons 50 and 51 to define chambers 80 and 81, respectively, which may be in direct fluid communication. Chambers 70 and 80 are separated fluidly by labyrinth seals 50-1 and 50-2 so that the only communication therebetween is via leakage past the labyrinth seals 50-1 and 50-2. Similarly, chambers 71 and 81 are separated fluidly by labyrinth seals 51-1 and 51-2 so that the only communication therebetween is via leakage past the labyrinth seals 51-1 and 51-2. High pressure passage 16-1 fluidly connects discharge port 16 with fluid path 74. Fluid path 74 fluidly connects high pressure passage 16-1, and thereby discharge port 16, with chamber 80 which is thereby maintained at, nominally, discharge pressure. Similarly, fluid path 74 and branch path 74-1 fluidly connect high pressure passage 16-1, and thereby discharge port 16, with chamber 81 which is thereby maintained at, nominally, discharge pressure. Alternatively branch path 74-1 can be eliminated if there is direct fluid communication between chambers 80 and 81.

As viewed in FIGS. 2 and 4, discharge pressure acts on the right end of rotors 20 and 21 tending to move rotors 20 and 21 to the left and to separate rotors 20 and 21 from end wall 17. Discharge pressure acting on the left side of balance disks or pistons 50 and 51 which are secured to the shaft of rotors 20 and 21, respectively, tends to move rotors 20 and 21 to the right as viewed in FIGS. 2 and 3. If the areas of balance disks or pistons 50 and 51 that are exposed to chambers 80 and 81 are properly sized the thrust forces produced by the discharge pressure cancel and thereby eliminate the need for thrust bearings. Suction pressure will act on the left end of rotors 20 and 21, i.e. shoulders 20-2 and 21-2, respectively, and tends to move rotors 20 and 21 to the right and away from end wall 15. Suction pressure in chambers 70 and 71 will tend to be elevated due to leakage of discharge pressure past labyrinth seals 50-1 and 50-2 into chamber 70 and past labyrinth seals 51-1 and 51-2 into chamber 71, but pressure in chambers 70 and 71 will act on the right side of balance disks or pistons 50 and 51, respectively, tending to move rotors 20 and 21 to the left in opposition to the pressure acting on shoulders 20-2 and 21-2, respectively.

By properly sizing the areas of balance disks or pistons 50 and 51 which are acted on by fluid pressure in chambers 70 and 80 and 71 and 81 and the ends of rotors 20 and 21 acted or by fluid pressure, the thrust force can be reduced at least to a degree where thrust bearings are not required.

Figure 5:
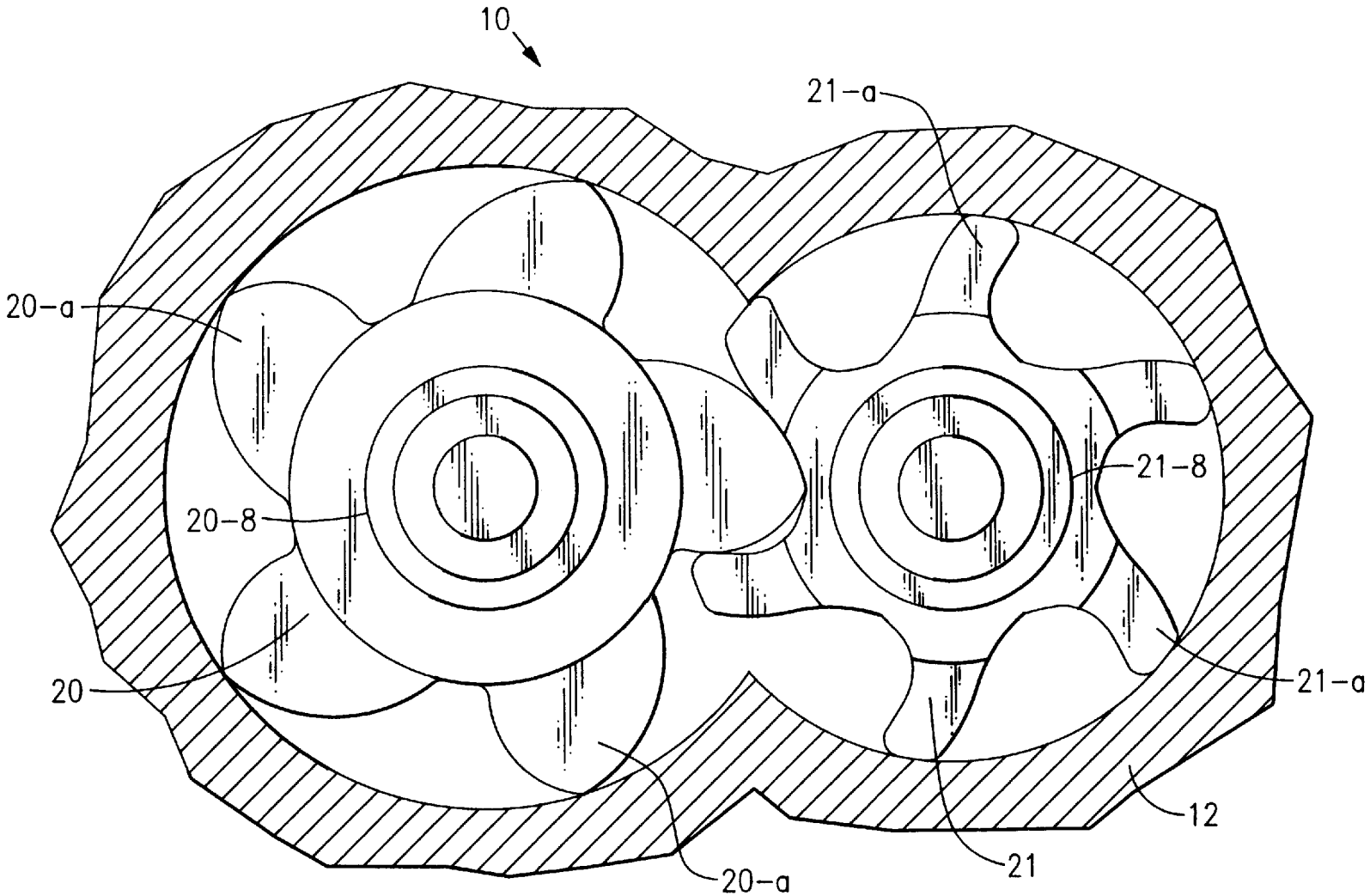
FIG. 5 is a discharge end view of the rotors of FIG. 4.

From the foregoing explanation, it should be clear that fluid pressure is required to act on certain areas and that leakage can present problems if not suitably controlled. One such area is the discharge end of the rotors 20 and 21. Reference to FIGS. 1A to 1F clearly shows that there are pressure gradients between adjacent trapped volumes which are at different stages in the compression process. To facilitate the discharge fluid pressure acting on the discharge ends of rotors 20 and 21 the lobes of rotors 20 and 21 are beveled or canted at their discharge ends. Referring specifically to FIGS. 4 and 5, the lobes of rotors 20 and 21 are beveled at an angle a such that the greatest depth of the surfaces 20-*a* and 21-*a* relative to end wall 17 is in the direction of rotation of the rotor. In addition to permitting discharge fluid pressure to act on surfaces 20-*a* and 21-*a*, the bevels defining surfaces 20-*a* and 21-*a* generate a hydrodynamic oil film tending to separate and seal surfaces 20-*a* and 21-*a* relative to the facing surface of end wall 17 during rotor rotation. The angle α is less than 1° and is preferably on the order of twenty to thirty minutes.

Although a preferred embodiment of the present invention has been illustrated and described other changes will occur to those skilled in the art. For example, the present invention could be applied to a three rotor screw machine. Also, the thrust balancing can be used on only the male rotor(s), only the female rotor(s) and on all of the rotors. It is therefore intended that the present invention is to be limited only by the scope of the appended claims.

What is claimed is:

1. A screw machine including a rotor housing, an inlet casing secured to said rotor housing, a pair of operatively connected rotors having first and second ends and located in said rotor housing with each rotor having a shaft portion extending into said inlet casing, bearing means supporting said rotors, means for supplying gas at suction pressure to said rotors and means for delivering compressed gas at discharge pressure from said rotors, gas at discharge pressure acting on a first end of each of said rotors and tending to move each of said rotors in a first direction, thrust balancing structure for providing a force on at least one of said rotors tending to move said one rotor in a second direction which is opposite to said first direction, said thrust balancing structure comprising:

fluid pressure responsive means located on the respective shaft portion of said one rotor so as to be integral therewith;

said fluid pressure responsive means forming a portion of a first sealed chamber having a first surface exposed to said first sealed chamber such that fluid pressure acting on said first surface tends to move said one rotor in said second direction; and means for supplying gas at discharge pressure to said first sealed chamber.

2. The screw machine of claim 1 wherein:

said fluid pressure responsive means has a second surface spaced from said first surface such that fluid pressure acting on said first surface opposes fluid pressure acting on said second surface;

said second surface forming a portion of a second sealed chamber; and means for supplying gas at suction pressure to said second sealed chamber.

3. The screw machine of claim 2 wherein labyrinth seal means are located between said first and second sealed chambers.

4. The screw machine of claim 1 wherein said first end of said one rotor is beveled.

5. The screw machine of claim 4 wherein said beveled first end is at an angle of less than 1°.

6. The screw machine of claim 1 further including thrust balancing structure for providing a force on a second one of said rotors in said second direction, said thrust balancing structure for said second one of said rotors comprising:

second fluid pressure responsive means located on the respective shaft portion of said second one of said rotors so as to be integral therewith;

said second fluid pressure responsive means forming a portion of a second sealed chamber having a first surface exposed to said second sealed chamber such that fluid pressure acting on said first surface of said second fluid pressure responsive means tends to move said second one of said rotors in said second direction; and means for supplying gas at discharge pressure to said second sealed chamber.

7. The screw machine of claim 6 wherein:

said second fluid pressure responsive means has a second surface spaced from said first surface of said second fluid pressure responsive means such that fluid pressure acting on said first surface of said second fluid pressure responsive means opposes fluid pressure acting on said second surface of said second fluid pressure responsive means;

said second surface of said second fluid pressure responsive means forming a portion of a second sealed chamber; and means for supplying gas at suction pressure to said second sealed chamber.

8. The screw machine of claim 6 wherein said first end of said second one of said rotors is beveled.

9. The screw machine of claim 8 wherein said beveled first end of said second one of said rotors is at an angle of less than 1°.

* * * * *